US005582870A

United States Patent [19]

Shigesada et al.

[11] Patent Number: 5,582,870

[45] Date of Patent: Dec. 10, 1996

[54] COATING METHOD FOR APPLYING A COATING COMPOSITION ONTO A RUNNING FLEXIBLE SUPPORT

[75] Inventors: Keiji Shigesada; Akihiro Suzuki; Norio Shibata, all of Kanagawa, Japan

[73] Assignee: Fuji Photo Film Co., Ltd., Kanagawa, Japan

[21] Appl. No.: 487,636

[22] Filed: Jun. 7, 1995

Related U.S. Application Data

[63] Continuation of Ser. No. 230,379, Apr. 20, 1994, abandoned.

[30] Foreign Application Priority Data

Apr. 20, 1993 [JP] Japan ..... 5-116337

[51] Int. Cl.[6] ..... B05D 3/12

[52] U.S. Cl. ..... 427/358; 427/356; 427/359; 118/410

[58] Field of Search ..... 427/356, 358, 427/128, 359; 118/410, 411

[56] References Cited

U.S. PATENT DOCUMENTS

| | | | |
|---|---|---|---|
| 4,357,801 | 8/1985 | Takeda | 427/356 |
| 5,206,056 | 4/1993 | Shibata et al. | 427/356 |
| 5,250,320 | 10/1993 | Suzuki et al. | 427/128 |

*Primary Examiner*—Katherine Bareford
*Attorney, Agent, or Firm*—Sughrue, Mion, Zinn, Macpeak & Seas

[57] ABSTRACT

A coating method for applying a coating composition mainly containing an organic solvent onto a running flexible support 11 by ejecting the coating composition in an oversupply state from a slit 9 under pressure. A back edge top end surface 14 on the upstream side in the direction of running of the support with respect to the slit is set so as to be substantially parallel to the surface of the support. A liquid-detached position in which the coating composition ejected from the slit to overflow the slit is detached from a surface of the support 11 is set so as to be placed on the back edge surface opposite to the support.

1 Claim, 2 Drawing Sheets

COATING METHOD FOR APPLYING A COATING COMPOSITION ONTO A RUNNING FLEXIBLE SUPPORT

This is a continuation of application Ser. No. 08/230,379 filed Apr. 20, 1994, now abandoned.

BACKGROUND OF THE INVENTION

The present invention relates to a coating method for coating a flexible support with a coating composition mainly containing an organic solvent, and particularly to a coating method in which a running flexible support laid between pass rolls is coated with a coating composition while a coating head having a back edge and a doctor edge is pressed to the flexible support.

Heretofore, various apparatuses have been proposed as coating apparatuses of the type of coating a running support with a coating composition. As one of this type of coating apparatuses, there is a coating apparatus in which a coating composition mainly containing an organic solvent is applied. The coating apparatus for application of a coating composition mainly containing an organic solvent is used, for example, for cleaning a support or forming an undercoating layer thereof before application of a magnetic dispersion or for forming a back layer in the case of a magnetic tape or the like.

As a method for forming an undercoating layer as described above or the like, there is a method as disclosed in Japanese Patent Unexamined Publication No. Sho-57-156066, in which after a running support is coated with a coating composition of a coating composition tank through a rotating coating drum, the thickness of a coating film is adjusted by a coating film thickness adjusting member to obtain a desired coating layer. Here, a metering means (quantification means) such as wire knife, blade, wire bar, etc. is used as the coating film thickness adjusting means. Further, a rod member which rotates in a direction reverse to the direction of running of the support can be used in the apparatus.

On the other hand, Japanese Patent Unexamined Publication No. Sho-62-60750 has disclosed an apparatus in which a slit is provided to be capable of supplying an organic solvent to a running support and in which a surface of the running support is cleaned by scraping off an organic solvent type coating composition with use of a rod member rotatably provided at a top portion of the slit while rotating the rod member suitably and ejecting the coating composition from the slit.

As described above, various apparatuses using a process of application of an organic solvent type coating composition, for example, as a process before a process of application of a magnetic dispersion have been proposed and employed conventionally.

Of the coating apparatuses for application of an organic solvent type coating composition, the apparatus for application of a coating composition from a slit under suitable pressure (liquid pressure) as disclosed in Japanese Patent Unexamined Publication No. Sho-62-60750 has an advantage in that the apparatus is adapted to high coating speed. That is, air which is associated with the support as the liquid pressure of the coating composition ejected from the slit is increased can be removed smoothly. That is, the apparatus contributes to stabilization of high-speed coating.

In a coating head used in the conventional coating apparatus, there is however a large problem when the liquid pressure of the coating composition is increased. This problem is in that a mist of the solvent of the coating composition is produced in the upstream side in the direction of running of the support (in the upstream side of the slit) because the internal liquid pressure of the coating composition ejected from the slit of the coating head is instantaneously released to atmospheric pressure when the coating composition is ejected from the slit. When a large quantity of the mist is produced, there arises a problem that a solvent atmosphere is increased so that work environment is made undesirable.

In the method of performing application of a magnetic layer after application of a pre-coating composition mainly containing an organic solvent in a process of producing a magnetic recording medium as described in Unexamined Japanese Patent Publication (Kokai) No. Sho. 63-20069, there arises a problem that the mist of the pre- coating composition is deposited onto the magnetic layer again to cause coating film failure.

SUMMARY OF THE INVENTION

An object of the present invention is to provide a coating method in which when a running support is coated with an organic solvent type coating composition under predetermined liquid pressure, such a solvent mist is prevented from being produced in the upstream side in the direction of running of the support, of a coating head.

The foregoing object of the present invention can be achieved by a coating method in which while a coating head having a slit positioned between a back edge and a doctor edge is pressed to a running flexible support laid between pass rolls, a coating composition mainly containing an organic solvent is ejected from the slit under pressure and in an oversupply condition to thereby coat the flexible support with the coating composition, characterized in that: a surface opposite to the support, of the back edge on the upstream side in the direction of running of the flexible support with respect to the slit is set so as to be substantially parallel to the surface of the support; the coating composition ejected from the slit is made to overflow toward the back edge surface opposite to the support; and a liquid-detached position in which the coating composition is detached from a surface of the support is set so as to be placed on the back edge surface opposite to the support.

DESCRIPTION OF THE PREFERRED EMBODIMENTS

An embodiment of the present invention will be described below by using a coating apparatus for carrying out the coating method of the present invention with reference to the accompanying drawings.

Figure 1:
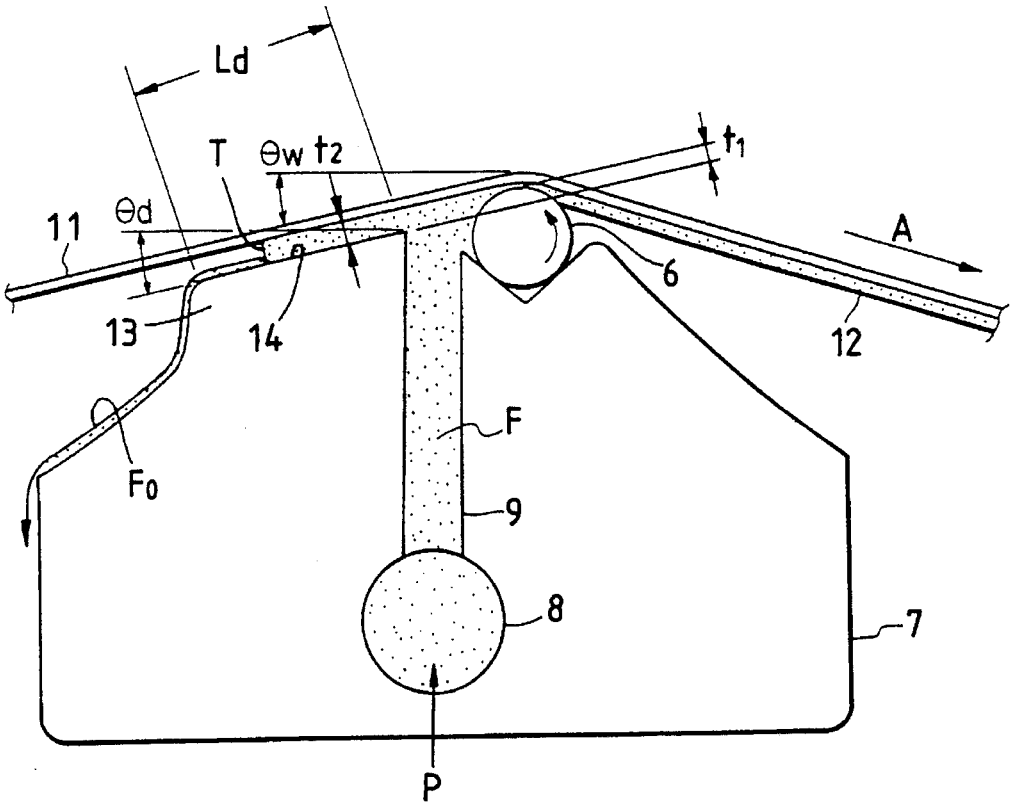
FIG. 1 is a schematic view of an embodiment of a coating apparatus according to the present invention.

FIG. 1 shows an embodiment of a coating apparatus for forming an undercoating layer while performing cleaning and metering in a process of producing a magnetic recording medium.

As shown in FIG. 1, the coating apparatus 7 in this embodiment is disposed in the downstream side of a support 11 which is running in a predetermined direction (the direction of the arrow A). A coating composition F receives pressure from a pressure device not shown so that the coating composition F is supplied to a pocket 8 through a liquid feeding system P and ejected from the pocket 8 toward the support 11 through a slit 9. A rotary rod 6 is provided in the downstream side of a discharge outlet of the slit 9 so that the rotary rod 6 is driven by a driver not shown to be rotated in a direction reverse to the direction of running of the support 11.

The feature of this embodiment is in a structure in which a back edge 13 on the upstream side in the direction of running of the support 11 with respect to the slit 9 has a surface 14 opposite to the support and substantially parallel to the surface of the support 11 (i.e., the angle of incidence $\theta_w$ of the support 11 and the angle of inclination $\theta_d$ of the back edge surface 14 are substantially the same). A liquid-detached position T in which the coating composition F ejected from the slit 9 to overflow the slit 9 is detached from the support 11 is set so as to be placed on the surface 14 opposite to the support.

The length $L_d$ of the surface 14 opposite to the support is preferably selected to be not smaller than 2 mm when, for example, the liquid pressure at the outlet of the slit 9 is not lower than 0.02 Kg/cm$^2$ (if the discharge liquid pressure is lower than 0.02 Kg/cm$^2$, the solvent mist is little produced). The difference t1 between the surface 14 opposite to the support and an upper end portion of the rotary rod 6 can be selected to be in a range of from 0.02 to 00.5 mm.

As described above, a flow of the coating composition F from the slit 9 to the upstream side (back edge side) forms a liquid reservoir in the distance t2 (substantially equal to the distance t1) formed between the running support 11 and the surface 14 opposite to the support and then forms a drop flow $F_0$. Therefore, even in the state where the liquid pressure in the slit 9 is high, the drop flow $F_0$ is formed after the liquid pressure is once lowered in the liquid reservoir. As a result, the rapid change of the pressure of the coating composition F from high liquid pressure to atmospheric pressure is avoided. Accordingly, the rapid volatilization of the organic solvent in the coating composition is suppressed so that the solvent mist as produced conventionally can be prevented from being produced.

The drop flow $F_0$ may be recovered suitably by a recovering system not shown or may be filtrated to be recycled if necessary.

The coating composition F applied by the coating apparatus 7 mainly contains an organic solvent. For example, the coating composition F can contain as the organic solvent an arbitrary percentage of a material selected from ketones such as acetone, methyl ethyl ketone, methyl isobutyl ketone, diisobutyl ketone, cyclohexanone, isophorone, tetrahydrofuran, etc.; alcohols such as methanol, ethanol, propanol, butanol, isobutyl alcohol, isopropyl alcohol, methyl cyclohexanol, etc.; esters such as methyl acetate, butyl acetate, isobutyl acetate, isopropyl acetate, ethyl lactate, glycol acetate, etc.; glycol ethers such as glycol methyl ether, glycol monoethyl ether, dioxane, etc.; aromatic hydrocarbons such as benzene, toluene, xylene, cresol, chlorbenzene, etc.; chlorinated hydrocarbons such as methylene chloride, ethylene chloride, carbon tetrachloride, chloroform, ethylene chlorhydrin, dichlorbenzene, etc.; and others such as N-N-dimethyl formamide, hexane, etc. It is not always necessary that these organic solvents are provided in the 100% purity. That is, these organic solvents may contain impurities such as unreacted product, side-reaction product, decomposition product, oxide, water, etc. as other components than main components. The amount of these impurities is selected to be preferably not larger than 30%, more preferably not larger than 10%.

The thickness (the quantity of coating) of the coating layer 12 formed on the support 11 can be adjusted in accordance with conditions such as the tension of the support 11, the running speed of the support, the size of the rotary rod 6, the rotational speed of the rotary rod 6, the viscosity of the coating composition, and so on.

Figure 2:
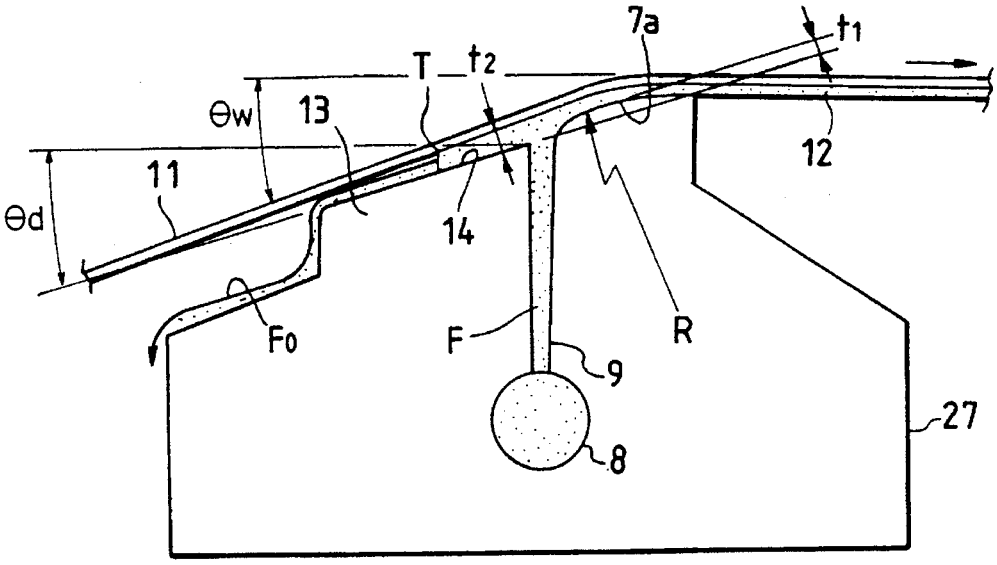
FIG. 2 is a schematic view of another embodiment of a coating apparatus according to the present invention.

The coating apparatus for carrying out the coating method of the present invention is not limited to the structure in which the apparatus has a rotary rod 6 as described in the aforementioned embodiment. That is, various changes can be made. For example, an extrusion type coating apparatus 27 with a doctor edge 7*a* as shown in FIG. 2 may be used. In FIG. 2, constituent parts the same as constituent parts shown in FIG. 1 are referenced by like numerals for the purpose of omitting the description thereof.

As described above, in the coating method according to the present invention, not only the opposite to the support, of the back edge on the upstream side in the direction of running of the support with respect to the slit is set so as to be substantially parallel to the surface of the support, but the liquid-detached position in which the coating composition ejected from the slit to overflow the slit is detached from a surface of the support is set so as to be placed on the surface opposite to the support. Accordingly, because a flow the coating composition from the slit to the upstream side forms a liquid reservoir in the distance produced between the support and the surface opposite to the support before the flow forms a drop flow, the liquid pressure is once reduced in the liquid reservoir. As a result, the rapid change of the liquid pressure of the coating composition from high liquid pressure to atmospheric pressure is avoided. Accordingly, the rapid volatilization of the organic solvent in the coating composition is suppressed so that the solvent mist as produced conventionally can be prevented from being produced.

As a result, not only the worsening of environment caused by the volatilization of the solvent can be eliminated but, for example, even in the case where another coating film is successively formed in the downstream side of the coating apparatus, the coating film failure caused by the re-deposition of the mist onto the coating film can be eliminated.

[EXAMPLES]

The effects of the present invention will become clearer from the following specific examples of the present invention.

(Example 1)

The condition of production of the mist in the upstream side in the case where methyl ethyl ketone which was a solvent was applied onto the support 11 by using the coating apparatus 7 shown in FIG. 2 was examined by eyes.

The width of the slit 9 was 0.3 mm. The viscosity $\eta$ of methyl ethyl ketone, the flow rate of methyl ethyl ketone and the blowout pressure of methyl ethyl ketone were in a range of from 0.5 to 10 cp, 5 LT/min and about 0.02 kg/cm$^2$, respectively. The tension of the support 11 was 15 kg/m. The running speed of the support was 200 m/min. The diameter of the rotary rod 6 and the rotational speed of the rotary rod 6 were set to be 4 mm and 100 rpm, respectively.

The angle $\theta_w$ of incidence of the support 11 and the distance t2 between the outlet of the slit 9 and the support 11 were set to be 15° and 0.05 mm, respectively. The influence on the prevention of the production of the mist, of the length $L_d$ of the surface 14 opposite to the support and the angle $\theta_d$ of inclination of the surface 14 opposite to the support was examined.

Figure 3:
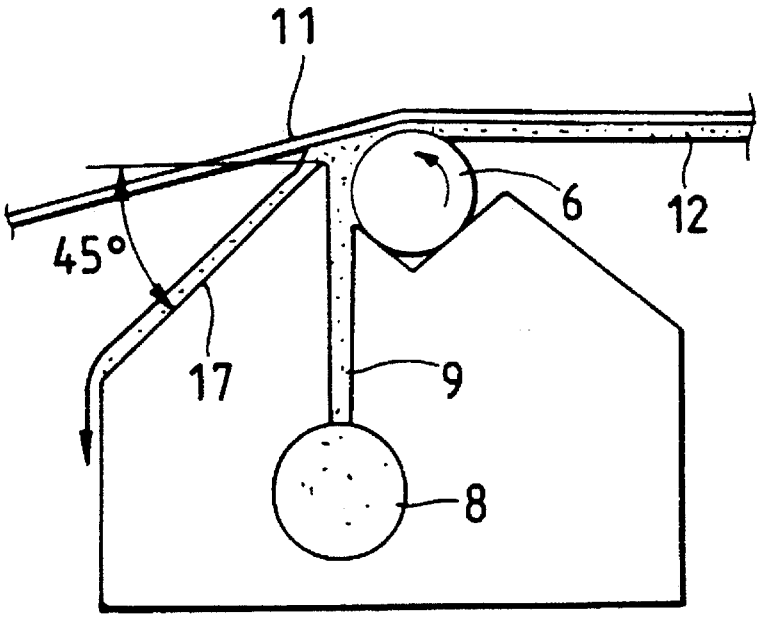
FIG. 3 PRIOR ART
FIG. 3 is a schematic view of a conventional coating apparatus.

As a comparative example, an experiment was made by using a coating apparatus having an upstream side inclined surface 17 having no upstream side parallel portion, as shown in FIG. 3. The angle $\theta_d$ of inclination of the upstream side inclined surface 17 used was 45°.

Further, an experiment was made by using a coating apparatus in which the coating film thickness adjusting method using a rotary rod was not employed in the downstream side of the coating apparatus but a doctor edge surface with a curvature radius R=10 mm as shown in FIG. 2 was employed. The other structure was the same as that of the coating apparatus in FIG. 1.

Results of the experiments were shown in Table 1.

TABLE 1

| Experiment | Coating Apparatus | θ | L | Mist Condition | Level |
|---|---|---|---|---|---|
| 1 | FIG. 1 | 15° | 10 mm | No observation by eyes | ○ |
| 2 | FIG. 1 | 15° | 2 mm | A very small quantity | Δ–○ |
| 3 | FIG. 1 | 20° | 10 mm | A small quantity | Δ |
| 4 | FIG. 2 | 10° | 10 mm | A small quantity | Δ |
| 5 (Comparative Example) | FIG. 3 | 45° | 0 mm | Observation on the whole | x |

It was apparent from Table 1 that the production of the mist could be effectively prevented by a parallel portion 14 which was provided on the upstream side of the blowout outlet of the coating apparatus so as to be parallel to the support 11.

In the case where the discharge liquid pressure at the outlet of the slit was not higher than 0.02 Kg/cm$^2$, the solvent mist was little produced even in the conventional apparatus (FIG. 3). As a result of examination of the length of the surface 14 opposite to the support to eliminate the solvent mist in the case where the discharge liquid pressure was not lower than 0.02 Kg/cm$^2$ in which the production of the solvent mist was started, it became apparent that the mist was eliminated effectively when the length was not smaller than 2 mm.

(Example 2)

There were shown results of experiments in which coating was carried out by using a magnetic dispersion in a position near to the coating apparatus of Example 1.

The magnetic dispersion used was prepared by mixing and dispersing components shown in Table 2 in a ball mill for 10.5 hours. As the support used was polyethylene terephthalate film with a thickness of 8 μm and a width of 300 mm. As the coating apparatus used was an extrusion type apparatus. The other conditions were the same as those in Example 1.

TABLE 2

| Coating composition | |
|---|---|
| Fe/Zn/Ni (weight proportion 92:4:4) powder (needle-like particles of average grain size in the direction of length: 0.20 μm, length/width ratio: 10, coercive force: 1600 oersted) | 300 parts by weight |
| vinyl chloride-vinyl acetate copolymer (copolymerization ratio: 87:13, copolymerization degree: 400) | 30 parts by weight |
| conductive carbon | 20 parts by weight |
| polyamide resin (amin-valent: 300) | 15 parts by weight |
| lecithin | 6 parts by weight |
| silicon oil (dimethyl polysiloxane) | 3 parts by weight |
| cyclohexanone | 300 parts by weight |
| methyl isobutyl ketone | 300 parts by weight |
| n-butanol | 100 parts by weight |

As a result of measurement, the viscosity of the aforementioned coating composition was 0.9 poise at the shear rate of 5×10 sec.

TABLE 3

| Experiment | Coating Apparatus | θ | L | Roughness of Magnetic Surface | Level |
|---|---|---|---|---|---|
| 6 | FIG. 1 | 15° | 10 mm | No observation by eyes | ○ |
| 7 | FIG. 1 | 15° | 2 mm | No observation by eyes | ○ |
| 8 | FIG. 1 | 20° | 10 mm | A very small quantity | Δ–○ |
| 9 | FIG. 2 | 10° | 10 mm | A very small quantity | Δ–○ |
| 10 (Comparative Example) | FIG. 3 | 45° | 0 mm | Observation on the whole | x |

It was apparent from the aforementioned experimental results that the coating method in which the support was set so as to be parallel to the surface opposite to the support, of the back edge on the upstream side of the slit was effective for the prevention of the production of the solvent mist and for the prevention of the bad influence of the solvent mist on the surface of the coating film of the magnetic dispersion.

What is claimed is:

1. A coating method in which while a coating head having a slit positioned between a back edge and a doctor edge is pressed to a running flexible support laid between pass rolls, a coating composition containing an organic solvent is ejected from said slit under pressure and in an oversupply condition to thereby coat said flexible support with said coating composition, said coating method further comprising the steps of:

setting an angle of inclination of a substantially planar surface, which is opposite to said support, of said back edge on the upstream side in a direction of running of said flexible support with respect to said slit so as to be substantially equal to an angle of incidence of said support, so that a surface of said support is substantially parallel to said substantially planar surface of said back edge;

overflowing said coating composition ejected from said slit toward said substantially planar back edge surface opposite to said support; and setting a liquid-detached position, including setting a length of said substantially planar back edge surface to be greater than or equal to 2 mm, and setting a discharge liquid pressure at an outlet of said slit to be greater than or equal to 0.02 $kg/cm^2$, in which said coating composition is detached from the surface of said support, so as to be placed on said substantially planar back edge surface opposite to said support, at a location spaced apart from an upstream end of said substantially planar back edge surface.

* * * * *